US010124458B2

(12) United States Patent
Dovel

(10) Patent No.: US 10,124,458 B2
(45) Date of Patent: Nov. 13, 2018

(54) CUTTING TOOL SHARPENER

(71) Applicant: Darex, LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 0 days.

(21) Appl. No.: 15/964,540

(22) Filed: Apr. 27, 2018

(65) Prior Publication Data

US 2018/0243875 A1 Aug. 30, 2018

Related U.S. Application Data

(63) Continuation of application No. 15/708,275, filed on Sep. 19, 2017, now Pat. No. 9,956,662, which is a continuation of application No. 14/213,264, filed on Mar. 14, 2014, now Pat. No. 9,849,556, which is a continuation of application No. 12/809,522, filed as application No. PCT/US2008/068412 on Jun. 26, 2008, now Pat. No. 8,696,407.

(60) Provisional application No. 61/016,294, filed on Dec. 21, 2007.

(51) Int. Cl.

| | |
|---|---|
| ***B24B 3/54*** | (2006.01) |
| ***B24B 3/36*** | (2006.01) |
| ***B24B 3/52*** | (2006.01) |
| ***B24B 21/20*** | (2006.01) |

(52) U.S. Cl.

CPC ..... *B24B 3/36* (2013.01); *B24B 3/52* (2013.01); *B24B 3/54* (2013.01); *B24B 21/20* (2013.01)

(58) Field of Classification Search

CPC ..... B24B 3/54; B24B 3/00; B24B 23/06

USPC ..... 451/45, 296, 310, 301, 349; 76/82

See application file for complete search history.

(56) References Cited

U.S. PATENT DOCUMENTS

| | | | |
|---|---|---|---|
| 1,246,958 | A | 11/1917 | Lindsey |
| 2,222,966 | A | 11/1940 | Williams |
| 2,341,068 | A | 2/1944 | Zummack |
| 2,566,809 | A | 9/1951 | Risley |
| 2,601,749 | A | 7/1952 | Johnson |
| 2,677,218 | A | 5/1954 | Lamison |
| 2,780,897 | A | 2/1957 | Albert |

(Continued)

FOREIGN PATENT DOCUMENTS

| | | |
|---|---|---|
| CA | 2005836 | 3/2000 |
| EP | 0156230 B1 | 9/1990 |

(Continued)

*Primary Examiner* — Robert Rose

(74) *Attorney, Agent, or Firm* — Hall Estill Attorneys at Law

(57) ABSTRACT

Apparatus for sharpening a cutting tool. In some embodiments, a powered sharpener has a main drive assembly with an electric motor, and a sharpening assembly with belt support surfaces to provide a routing path for the belt to define first and second belt segments. A first blade guide is configured to position a blade of the cutting tool at a first guide angle to sharpen a cutting edge of the blade against the first belt segment. A second blade guide is configured to position the blade at a second guide angle to sharpen the cutting edge of the blade against the second belt segment. The first and second belt segments may be parallel or non-parallel. As desired, anti-torsion members may be provided to contactingly engage a backing layer of the belt to resist torsional twisting of the belt during sharpening against the first and second belt segments.

30 Claims, 8 Drawing Sheets

(56) References Cited

U.S. PATENT DOCUMENTS

| | | | |
|---|---|---|---|
| 2,810,994 | A | 10/1957 | Schmidt |
| 2,832,179 | A | 4/1958 | Beltram |
| 3,562,801 | A | 2/1971 | Stucker |
| 3,714,742 | A | 2/1973 | Clark |
| 3,727,351 | A | 4/1973 | Hughes |
| 3,775,913 | A | 12/1973 | Clark |
| 3,801,293 | A | 4/1974 | Kiser |
| 3,871,141 | A | 3/1975 | Bonapace |
| 3,896,592 | A | 7/1975 | Wintz |
| 4,000,583 | A | 1/1977 | Stevens |
| 4,043,082 | A | 8/1977 | Ferroglio |
| 4,142,331 | A | 3/1979 | MacJannette |
| 4,320,892 | A | 3/1982 | Longbrake |
| 4,617,763 | A | 10/1986 | Edling |
| 4,627,194 | A | 12/1986 | Friel |
| 4,964,241 | A | 10/1990 | Conklin |
| 5,036,626 | A | 8/1991 | Fuchs |
| 5,109,638 | A | 5/1992 | Kime |
| 5,181,343 | A | 1/1993 | Teunissen |
| 5,193,314 | A | 3/1993 | Wormley et al. |
| 5,435,771 | A | 7/1995 | Lee |
| 5,611,726 | A | 3/1997 | Friel |
| 5,863,238 | A | 1/1999 | Felstehausen |
| 5,964,654 | A | 10/1999 | Ewert et al. |
| 6,071,183 | A | 6/2000 | Havins |
| 6,101,898 | A | 8/2000 | Gore |
| 6,113,476 | A | 9/2000 | Friel et al. |
| 6,648,737 | B2 | 11/2003 | Deware et al. |
| 6,875,093 | B2 | 4/2005 | Friel |
| 7,097,547 | B2 | 8/2006 | McCroary |
| 7,198,558 | B2 | 4/2007 | Levsen |
| 7,264,542 | B1 | 9/2007 | Leyva |
| 7,374,470 | B2 | 5/2008 | Fuchs |
| 8,696,407 | B2 | 4/2014 | Dovel |
| 8,784,162 | B1 | 7/2014 | Dovel |
| 9,333,612 | B2 | 5/2016 | Dovel |
| 2007/0243799 | A1* | 10/2007 | Fuchs ..... B24B 3/54 451/45 |
| 2008/0020681 | A1 | 1/2008 | Leyva |
| 2008/0096477 | A1 | 4/2008 | Lytinas |
| 2011/0136412 | A1 | 6/2011 | Dovel |
| 2012/0156972 | A1 | 6/2012 | Brown et al. |

FOREIGN PATENT DOCUMENTS

| | | |
|---|---|---|
| EP | 0352823 B1 | 1/1994 |
| EP | 0381003 B1 | 3/1994 |
| GB | 1511441 | 6/1978 |
| GB | 2168630 A | 6/1986 |
| JP | 01-222853 | 6/1989 |
| JP | 09-192990 | 7/1997 |

* cited by examiner

CUTTING TOOL SHARPENER

RELATED APPLICATIONS

The present application is a continuation of copending U.S. patent application Ser. No. 15/708,275 filed Sep. 19, 2017 and which will issue on May 1, 2018, which is a continuation of U.S. patent application Ser. No. 14/213,264 filed Mar. 14, 2014 and which issued Dec. 26, 2017 as U.S. Pat. No. 9,849,556, which was a continuation of U.S. patent application Ser. No. 12/809,522 filed Jun. 18, 2010 now issued as U.S. Pat. No. 8,696,407 and which is a 371 of International Patent Application No. PCT/US2008/068412 filed Jun. 26, 2008 and which in turn claims benefit to U.S. Provisional Patent Application No. 61/016,294 filed Dec. 21, 2007.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors, have a first opposing surface that extends in a substantially normal direction, and a second opposing surface that is skewed with respect to the first surface.

More complex geometries can also be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, etc. A limitation with these and other prior art sharpening techniques, however, is the inability to precisely define the opposing surfaces at the desired angles to provide a precisely defined cutting edge.

SUMMARY

Various embodiments of the present disclosure are generally directed an apparatus for sharpening a cutting tool.

In some embodiments, the apparatus is configured to sharpen a blade having opposing first and second side surfaces that converge to a cutting edge. The apparatus includes a main drive assembly and a sharpening assembly. The main drive assembly has an electric motor configured to drive a flexible abrasive belt at a selected speed and direction, the flexible abrasive belt having an abrasive outer surface and a backing layer inner surface. The main drive assembly further has a base structure configured to support the apparatus on a horizontal surface. The sharpening assembly is coupled to the main drive assembly and has a plurality of belt support surfaces to provide a routing path for the flexible abrasive belt. The belt support surfaces include multiple first support surfaces and multiple second support surfaces configured to contactingly engage the backing layer inner surface to provide first and second belt segments that extend between the multiple first support surfaces and the multiple second support surfaces. The sharpening assembly further has a first blade guide adjacent the first belt segment and a second blade guide adjacent the second belt segment. The first blade guide is configured to position the first side of the blade at a first guide angle with respect to the first belt segment with the cutting edge in contact with the abrasive outer surface along the first belt segment. The second blade guide is configured to subsequently position the second side of the blade at a second guide angle with respect to the second belt segment with the cutting edge in contact with the abrasive outer surface along the second belt segment.

DETAILED DESCRIPTION

Figure 1A:
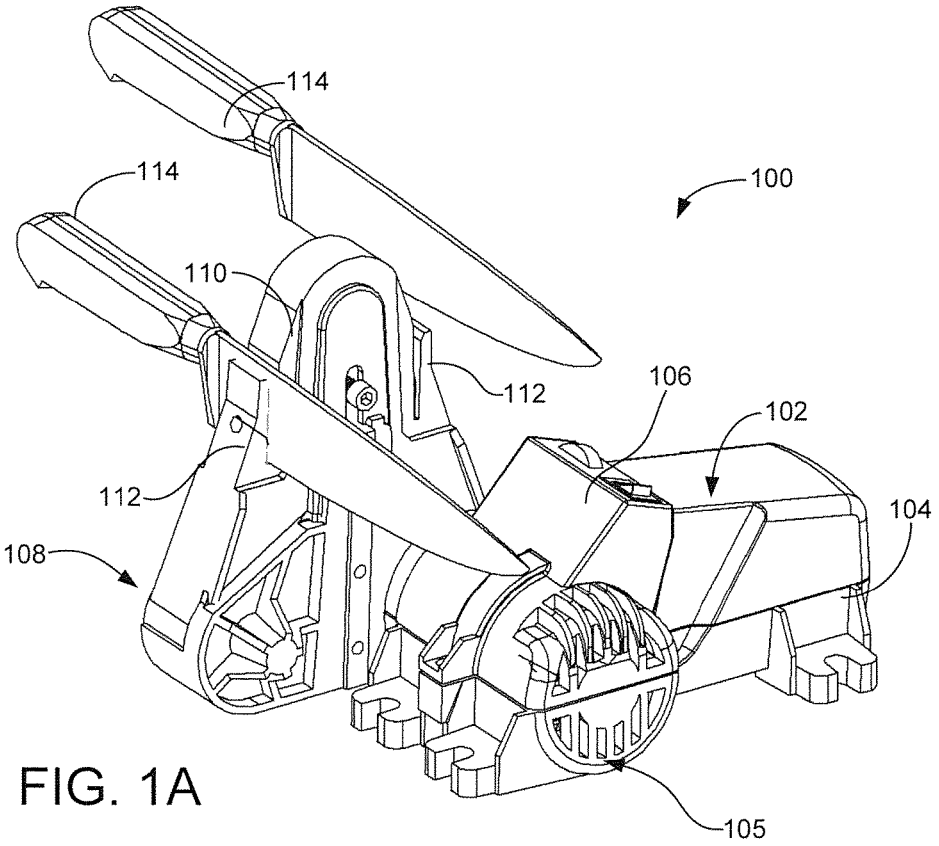
FIGS. 1A and 1B provide respective isometric and side elevational views of a cutting tool sharpener system (sharpener) constructed in accordance with various embodiments of the present disclosure.
Figure 1B:
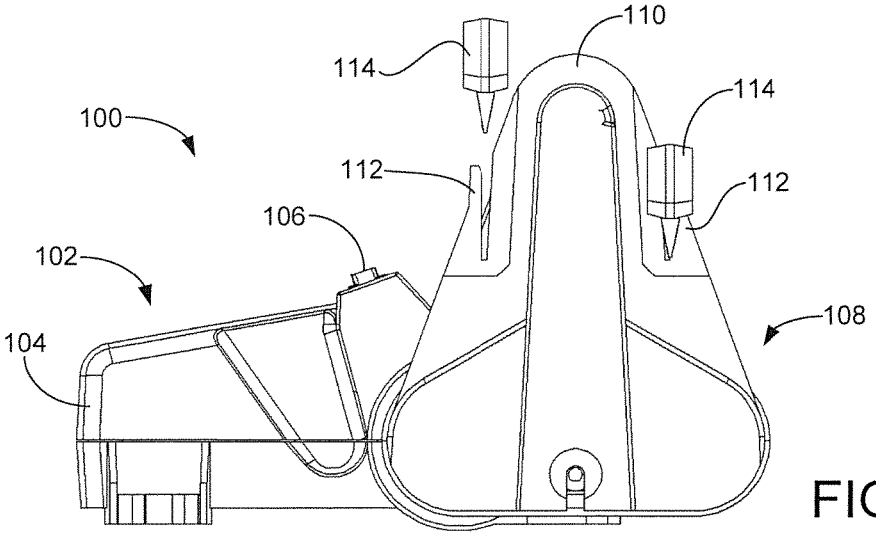

FIGS. 1A and 1B generally depict an exemplary cutting tool sharpener system 100 ("sharpener") constructed in accordance with various embodiments of the present disclosure. The sharpener 100 is configured to sharpen a number of different types of cutting tools in a fast and efficient manner.

The sharpener 100 includes a main drive assembly 102 with a housing 104 which encloses a drive assembly (generally denoted at 105). The drive assembly 105 can take any suitable configuration depending on the requirements of a given application. Preferably, the drive assembly 105 includes an electric motor which rotates at a selected rotational rate.

Suitable gearing or other torque transfer mechanisms can be used to provide a final desired rotational rate. In some embodiments, the rate and/or the direction of rotation can be adjusted, either automatically or manually by the user, for different sharpening operations. User control switches are generally depicted at 106.

The sharpener 100 further generally includes a sharpening assembly 108 coupled to the drive assembly. The sharpening assembly 108 preferably includes a substantially triangularly-shaped guide housing 110 with opposing sharpening guides 112 extending therein. The guides 112 enable a particular cutting tool, such as a kitchen knife 114, to be alternately presented to the sharpener 100 from opposing sides.

Figure 2:
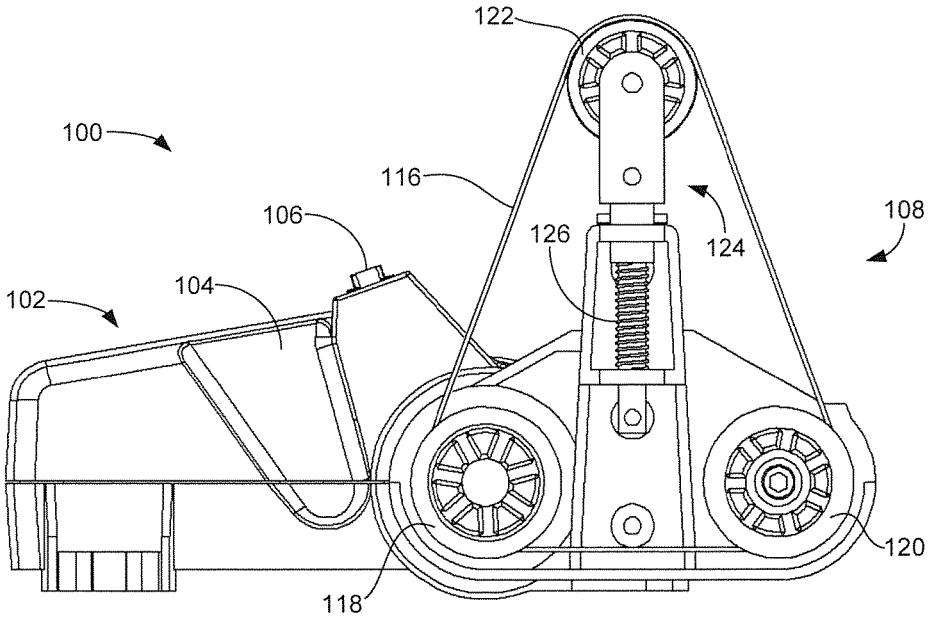
FIG. 2 shows the sharpener of FIGS. 1A-1B with a guide housing removed to expose various features of interest including an abrasive belt and three rollers.

FIG. 2 provides another view of the sharpener 100 of FIGS. 1A and 1B. In FIG. 2, the guide housing 110 has been removed to reveal a continuous, flexible abrasive belt 116 which is routed around rollers 118, 120 and 122. The roller 118 is characterized as a drive roller which is powered by the aforementioned drive assembly. The roller 120 is a fixed idler roller, and the roller 122 is a spring biased idler roller with an associated tensioner assembly 124.

Figure 3:
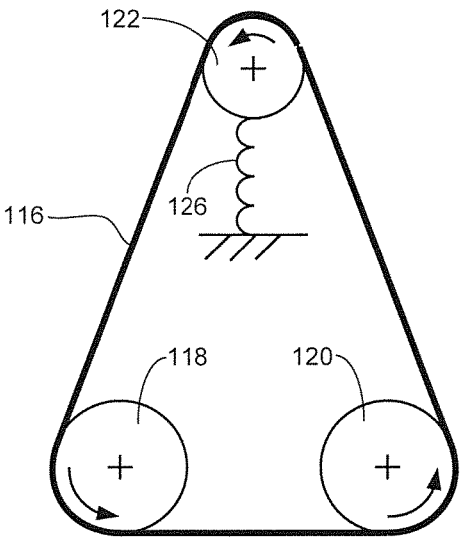
FIG. 3 is a schematic depiction of FIG. 2.
Figure 4A:
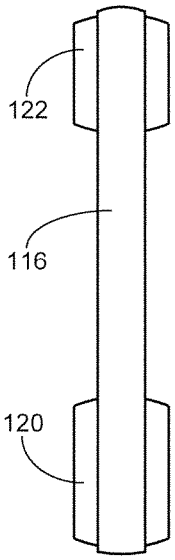
FIG. 4A provides an end view of the arrangement of FIG. 3 with the use of crowned rollers.
Figure 4B:
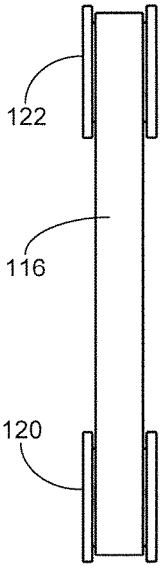
FIG. 4B provides an alternative end view of the arrangement of FIG. 3 with the use of guide rollers.

The tensioner assembly 124 preferably includes a coiled spring 126 or other biasing mechanism which applies an upwardly directed tension force upon the belt, as generally depicted in FIG. 3. The rollers 118, 120 and 122 are preferably crowned to maintain centered tracking of the belt 116, as generally represented in FIG. 4A, although guide rollers can additionally or alternatively be used, as generally represented in FIG. 4B. While a substantially triangular path for the belt 116 is preferred, such is not necessarily required as any number of other arrangements can be used as desired.

For example, in an alternative embodiment the belt 116 is routed around just two rollers rather than the three shown in FIG. 3. The rollers can be the same diameter to provide a substantially oval shaped path, or a larger roller can be used in lieu of the two lower rollers shown in FIG. 3 to maintain a substantially triangular path. More than three rollers can also be used to provide other path configurations. It will be appreciated that in each of these embodiments, the system can be characterized as aligning the belt along a first selected plane between first and second supports (e.g., such as on the left hand side of FIG. 3), and aligning the belt along a second selected plane between a third support and the first support (e.g., such as on the right hand side of FIG. 3).

The belt 116 nominally rotates at a speed and direction around the rollers 118, 120, 122 as determined by the operation of the drive assembly. It is contemplated that a population of belts will be supplied for use with the sharpener 100, each belt having different physical characteristics and each being easily removable from and replaceable onto the sharpener 100 in turn.

Figure 5A:
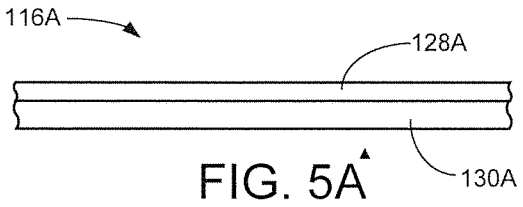
FIGS. 5A and 5B show side and top plan views of portions of a first belt.
Figure 5B:
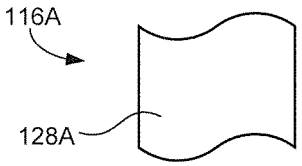

By way of illustration, FIGS. 5A and 5B provide respective side and top views of a first belt 116A. The belt 116A preferably includes a layer of abrasive material 128A affixed to a backing (substrate) layer 130A. The abrasive layer can take any number of forms, such but not limited to diamond particles, sandpaper material, etc., and will have a selected abrasiveness level (roughness). The backing layer 130A can similarly be selected from a wide variety of materials, such as cloth, plastic, paper, etc.

In the present example, the first belt 116A is contemplated as having an abrasiveness level on the order of about 400 grit. It is contemplated that the relative width, thickness and roughness of the first belt 116A will make the belt suitable for initial grinding operations upon the cutting tool in which relatively large amounts of material are removed from the tool.

Figure 6A:
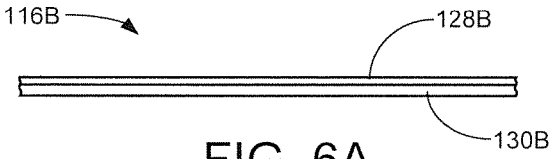
FIGS. 6A and 6B show side and top plan views of portions of a second belt.
Figure 6B:
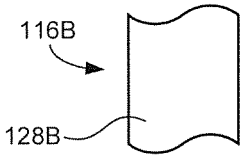

FIGS. 6A and 6B show a second exemplary belt 116B. The second belt 116B also has an abrasive layer 128B and a backing layer 130B. The abrasive layer 128B is contemplated as comprising a finer grit than that of the first belt 116A, such as order of about 1200 grit. The exemplary second belt 116B is contemplated as being generally more flexible than the first belt 116A.

The second belt 116B is shown to be narrower than the first belt 116A, to demonstrate that the sharpener 100 can be readily configured to accommodate different widths of belts. However, in preferred embodiments, all of the belts utilized by the sharpener 100 will have nominally the same width and length dimensions. Further, for reasons that will be discussed below, it is preferred that belts of coarser grit (such as the first belt 116A) will be configured to have successively higher levels of linear stiffness, whereas belts of finer grit (such as the second belt 116B) will be configured to have successively lower levels of linear stiffness.

As used herein, the term "linear stiffness" generally relates to the ability of the belt to bend (displace) along the longitudinal length of the belt (i.e., in a direction along the path of travel) in response to a given force. Generally, a belt with a higher linear stiffness will provide a larger radius of curvature as it is deflected by an object, since the belt has a relatively lower amount of flexibility along its length. Conversely, a belt with a lower linear stiffness, due to its relatively higher level of flexibility, will provide a smaller radius of curvature as it is deflected by the same object.

Accordingly, the second belt 116B is particularly suited for subsequent grinding or honing operations upon the cutting tool in which relatively smaller amounts of material are removed from the tool. It will be appreciated that the relative dimensions represented in FIGS. 5-6 are merely exemplary in nature and are not limiting. For example, all of the belts may be of the same general thickness with different flexibilities established by other characteristics, such as the material used to form the belts, the composition of the backing layers, etc. Also, any number of additional belts can be provided with other dimensions and levels of abrasiveness, including belts with a grit of 40 or lower, belts with a grit of 2000 or higher, etc.

It is contemplated that all of the belts will have generally the same circumferential length, but this is also not necessarily required as at least some differences in belt length can be accommodated via the tensioner 124. Indeed, as will now be explained beginning with FIGS. 7A-7B, a number of factors including the tensioner force and the belt length, width, thickness and stiffness are preferably selected to provide specifically controlled amounts of linear and torsional deflection of the belt during sharpening.

Figure 7A:
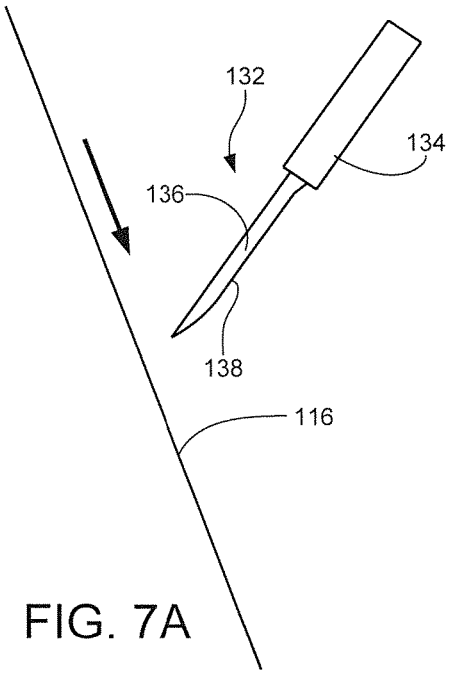
FIGS. 7A and 7B provide schematic depictions of the sharpener to generally illustrate a twisting (localized torsion) of the unsupported abrasive belt during a sharpening operation upon a cutting tool.
Figure 7B:
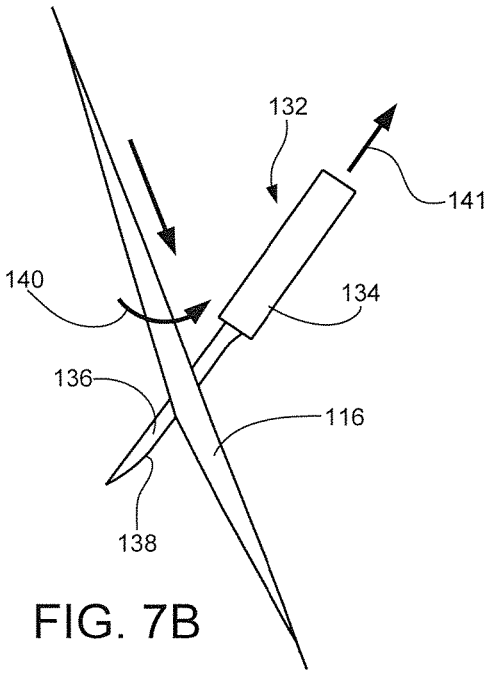

FIGS. 7A and 7B provide schematic representations of the sharpener 100 to illustrate preferred operation of a selected belt 116 during a sharpening operation upon a cutting tool 132. FIG. 7A shows the cutting tool 132 prior to engagement with the belt 116, and FIG. 7B shows the cutting tool 132 during engagement with the belt 116.

For reference, the cutting tool 132 is shown in a canted orientation, and for purposes of the present example the cutting tool is characterized as a conventional kitchen knife with handle 134, blade 136 and curvilinearly extending cutting edge 138.

As shown in FIG. 7B, the belt 116 preferably twists out of its normally aligned plane, as indicated by torsion arrow 140, in the vicinity of the knife 132 as the cutting edge 138 is drawn across the belt 116. More specifically, the user preferably grasps the handle 134 and pulls the knife 132 back in a substantially linear fashion, as indicated by arrow 141. The moving belt 116 will undergo localized torsion (twisting) to maintain a constant angle of the abrasive layer 128 against the blade 136 irrespective of the specific shape of the cutting edge 136. In this way, a constant and consistent grinding plane can be maintained with respect to the blade material.

The amount of torsional displacement of the belt along a particular cutting edge can vary widely in relation to changes in the curvilinearity of the cutting edge. A typical amount of twisting may be on the order of 30 degrees or more out of plane. In extreme cases such as when the distal tip of a blade passes across the belt, twisting of up to around 90 degrees or more out of plane may be experienced. The torsion is generally a function of the length of the extent of the belt presented to the tool in comparison to the belt width, as well as a function of the tension applied to the belt applied by the tensioner assembly 124. Thus, it is contemplated that, generally, each of the belts respectively installed onto the sharpener 100 will undergo substantially the same amount of torsion irrespective of the abrasiveness or linear stiffness of the belt.

Figure 8A:
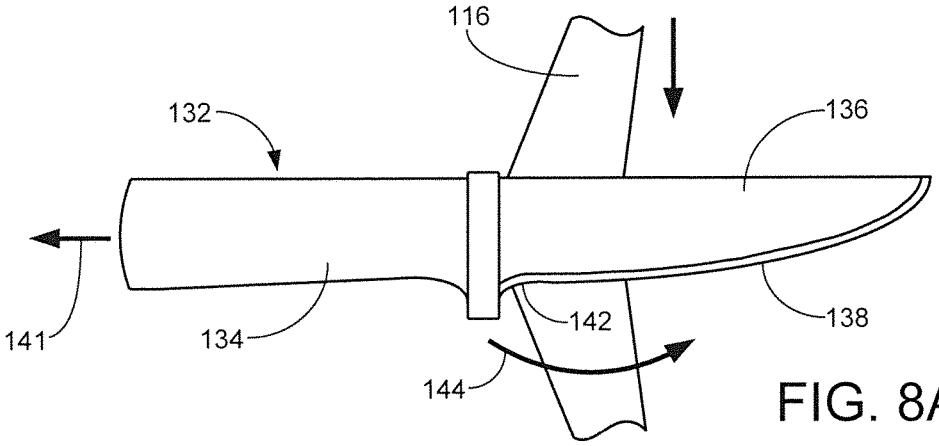
FIGS. 8A and 8B generally illustrate different torsion effects that may be encountered by the abrasive belt during the sharpening of the cutting tool of FIG. 7.

The direction of belt twist will be influenced by the relation of the cutting edge 138 to the belt 116. In FIG. 8A, a first portion 142 of the cutting edge 138 at the base of the blade 136 adjacent the handle 134 is generally concave with respect to the belt 116. This will generally induce torsion in a counter-clockwise direction, as indicated by arrow 144, as that portion of the blade passes adjacent the belt 116.

Figure 8B:
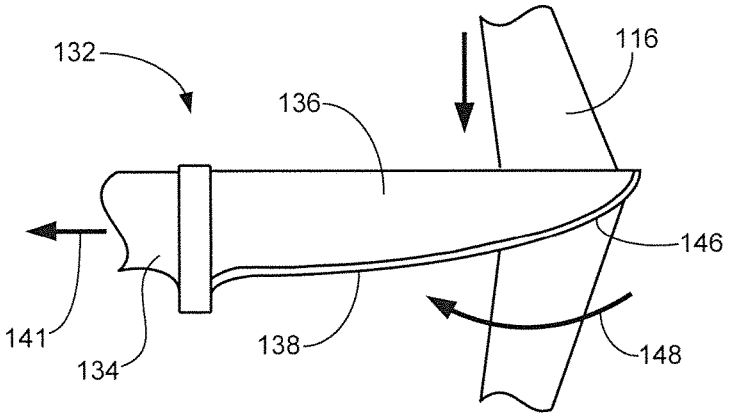

In FIG. 8B, a second portion 146 of the cutting edge 138 near the point of the blade 136 is generally convex with respect to the belt 116. Passage of the second portion 146 adjacent the belt will generally induce torsion in the opposite clockwise direction, as indicated by arrow 148.

Figure 9:
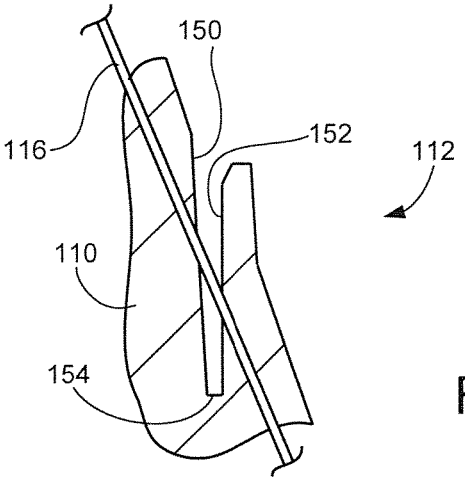
FIG. 9 shows a sharpening guide of the sharpener guide housing in greater detail.

In a preferred embodiment, the retraction of the knife 132 across the belt 116 is controlled by the aforementioned sharpening guides 112 in the guide housing 108 (FIG. 1). One of the guides 112 is generally depicted in FIG. 9. A slot is formed by facing surfaces 150, 152 and a base surface 154, although other configurations can be used, including angled surfaces that form a v-shape. During the sharpening steps of FIGS. 8A and 8B, the knife 132 is inserted into the slot above the belt 116 and moved downwardly until the base of the cutting edge 138 (portion 142 in FIG. 8A) comes into contacting abutment against the base surface 154 (also referred to as a cutting edge guide surface).

While maintaining a small amount of downward pressure upon the handle 134, the user slowly draws the knife 132 back (i.e., direction 141 in FIGS. 8A-8B) so that the cutting edge 138 remains in contact with, and slides against, the base surface 154. Preferably, the blade 136 is also lightly pressed against the vertical guide surface 152 so as to slidingly pass in contacting engagement with the surface 152 during the sharpening operation.

Although not shown in FIG. 9, a suitable retention feature, such as a spring clip or a magnet, can be incorporated into the guide 112 to maintain the knife 132 in contacting engagement with the surfaces 152, 154. The knife 132 is preferably passed across the belt several times in succession, such as 3-5 times, to sharpen a first side of the blade 136. The knife 132 is then preferably moved to the other guide (see FIG. 1) and these steps are repeated to sharpen the other side of the blade 136.

In some embodiments, the belt continues to rotate in a common rotational direction so that the belt moves "downwardly" with respect to the cutting tool on one side and "upwardly" with respect to the cutting tool on the other side. In other embodiments, the belt rotational direction is changed so as to pass downwardly on both sides, thereby drawing material down and past the cutting edge on both sides of the blade. Such change in belt rotational direction is not required in order to achieve effective levels of "razor" sharpness of the tool, but may be nevertheless be found to be beneficial in some applications. In such case, it is contemplated that the alternative directions of belt rotation can be manually set by the user, or automatically implemented by the sharpener 100 such as, for example, from the incorporation of a pressure switch or a proximity switch in each of the guides 112 to sense the presence of the cutting tool therein.

Figure 10A:
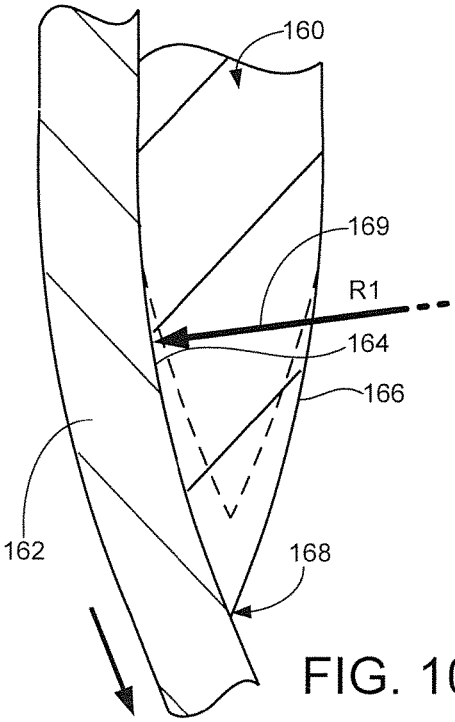
FIGS. 10A-10C generally depict a progression of symmetrical sharpening operations that may be advantageously performed upon a cutting tool to provide the tool with a desired final geometry.
Figure 10B:
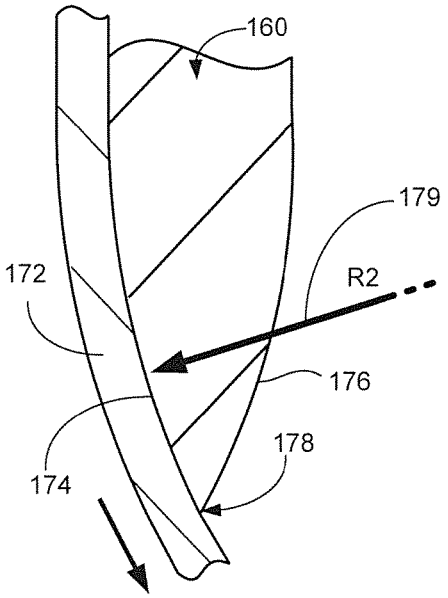
Figure 10C:
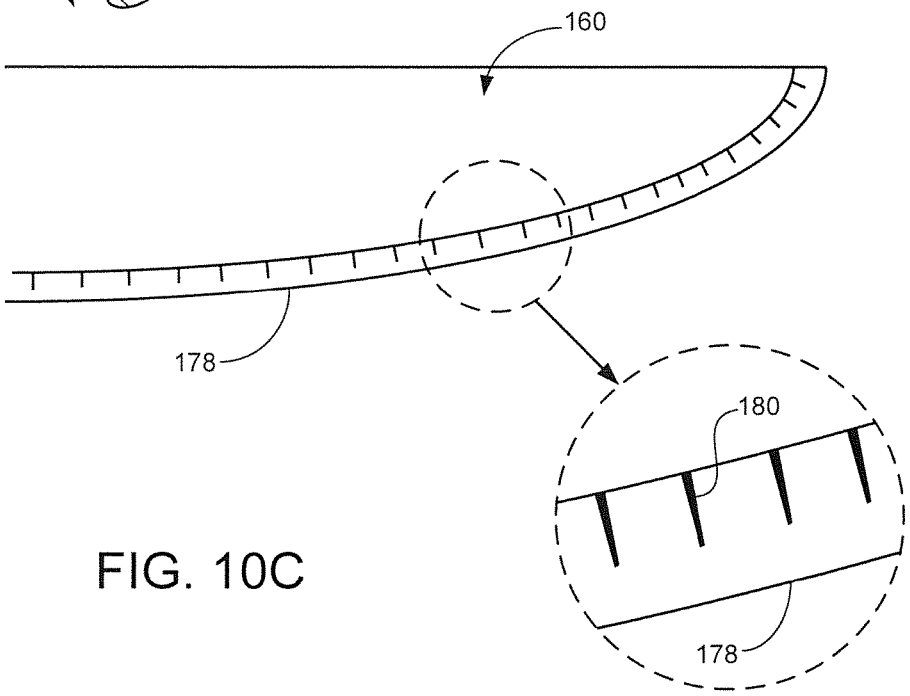

FIGS. 10A-10C generally illustrate a preferred sharpening sequence upon a blade 160. As will be recognized by those skilled in the art, the ability to obtain a superior sharpness for a given cutting tool will depend on a number of factors, including the type of material from which the tool is made. It has been found that certain types of processed steel, such as high grade, high carbon stainless steel, are particularly suitable to obtaining sharp and strong cutting edges. It will be appreciated, however, that the sharpener 100 can be readily adapted to provide extremely sharp cutting edges for any number of materials, including relatively lower grades of steel, high quality Damascus steel, ceramic blades, tools made of other metallic alloys or non-metallic materials, etc.

As set forth by FIGS. 10A-10C, the sharpener 100 generates a novel, convex grind surface geometry. FIG. 10A shows the blade 160 in conjunction with a first belt 162 which, when alternately applied to opposing sides of the blade 160, provides continuously extending, substantially convex surfaces 164, 166 which converge and intersect along a cutting edge 168. The first belt 162 is characterized as having a relatively coarse abrasive level, and relatively high linear stiffness characteristics.

FIG. 10B shows a subsequent grinding operation upon the blade 160 using a second belt 172 that forms opposing surfaces 174, 176 and a cutting edge 178. FIG. 10C is a side view depiction of the blade 160 at the conclusion of the operation of FIG. 10B. It will be appreciated that due to the torsional operation of the respective belts 162, 172, the cross-sectional geometries represented in FIGS. 10A-10B are nominally consistent along the entire longitudinal length of the blade (e.g., from substantially the tip of the blade to a position adjacent the handle).

The sharpening operation of FIG. 10A with the first belt 162 constitutes a relatively coarse, first stage grinding operation upon the blade material, and provides a relatively large radius of curvature upon the opposing sides 164, 166 of the blade 160. This radius of curvature (denoted as R1 at 169) is primarily established as a result of the relatively higher linear stiffness of the belt 162. Substantially this same radius of curvature is applied along the entire extent of the blade 160. (It will be appreciated that the length of the radius R1 is relatively large with respect to the scale of FIG. 10A, and therefore the origin of the radius does not fit on the page).

While the sharpening geometry of FIG. 10A can produce an extremely sharp cutting edge 168, a limitation that may be experienced with this particular sharpening geometry is the fact that the blade 160 is relatively thin for a substantial extent of the width of the blade 160. This can result in an undesirably weak blade that will deform, dull or break relatively easily if large forces are applied to the cutting edge 168.

Accordingly, it is contemplated that at the conclusion of this first stage of the sharpening operation, the first belt 162 is preferably removed from the sharpener 100 and the second belt 172 is installed, as depicted in FIG. 10B. The blade 160 is once again presented to the sharpener 100 and the second belt 172 applies a relatively fine (honing) grind upon the blade 160. This results in a correspondingly smaller radius of curvature (R2 at 179) upon each of the surfaces 174, 176 due to the reduced linear stiffness of the second belt 172.

As before, the second belt 172 undergoes torsion as the blade 160 is drawn across the belt so that the smaller radius of curvature shown in FIG. 10B is consistently applied along the extent of the blade 160. As noted above, the respective belts 162, 172 will preferably undergo substantially the same amounts of torsion during the respective grinding operations.

The smaller radius of curvature established by the more flexible second belt 172 generally localizes the honing operation to the vicinity of the end of the blade 160. The new cutting edge 178 (and the opposing surfaces 174, 176) result from the removal of material in FIG. 10B over what was present at the conclusion of the operation of FIG. 10A.

The effects of this localized honing operation in the vicinity of the cutting edge 178 are depicted in FIG. 10C. Generally, score (scratch) marks 180 may be present on the blade as a result of the relatively more aggressive abrasive of the first belt 162. The ends of these score marks 180, however, may be honed out of the blade in the vicinity of the final cutting edge 178 as a result of the secondary sharpening operation.

An advantage of the secondary sharpening process set forth by FIG. 10B is that the blade 160 now has the slicing advantages provided by the first surfaces 164, 166 of FIG. 10A, as well as greater blade strength due to the greater thickness in the vicinity of the cutting edge 178 resulting from the greater curvature of the second surfaces 174, 176.

While two belts have been discussed above, it will be appreciated that such is merely illustrative and not limiting. For example, sharpening can be accomplished using any number of belts of various abrasiveness and stiffness that are successively installed onto the sharpener 100 and utilized in turn. Conversely, sharpening operations can be effectively carried out using just a single belt of selected abrasiveness and stiffness.

For example, once the blade 160 has become dulled due to moderate use, all that may be required to restore the blade 160 to the sharpness of FIGS. 10B and 10C would be to re-present the blade 160 for sharpening against the second belt 172, thereby realigning the material along the cutting edge 178. Conversely, if greater wear or damage is incurred, the sharpness of the blade 160 can be restored by application of both belts 162, 172 to the blade.

The two belt sharpening process of FIGS. 10A-10C is particularly suitable for relatively harder materials such as laminated and/or high carbon steels, or other materials with a relatively high Rockwell Hardness level (such as on the order of e.g., 60 or higher). Such materials are sufficiently strong and hard to be able to transition from the relatively coarse grinding provided by the first belt 162 to the relatively fine grinding provided by the second belt 172 without undergoing deformation or other effects that would cause deviation from the displayed geometries.

Indeed, subjecting such relatively hard material to just the second belt 172 would ultimately result in the cutting edge 178, although such may require an extended period of time since the finer abrasiveness of the second belt will generally take longer to remove the requisite material from the blade to arrive at this final configuration. The use of multiple belts of varying abrasiveness is thus preferred for purposes of efficiency, but is not necessarily required. Similarly, it may be desirable to apply just the coarse grind of FIG. 10A for certain applications.

Softer materials such as lower grade steels with relatively lower Rockwell Hardness (such as on the order of, e.g., 45-50) may benefit from the use of higher numbers of sequential grinding stages. For example, a sequence of three different belts of 400 grit, 800 grit and 1200 grit may be respectively used in turn. This would tend to reduce the transitions between different belts, thereby reducing the risk of undesirably inducing folding or other deformations of the blade material in the vicinity of the cutting edge. Indeed, any number of belts, including 5-10 different belts or more, and belts of upwards of 2000 grit or more, can be progressively used as desired, depending on the requirements of a given application.

Figure 11:
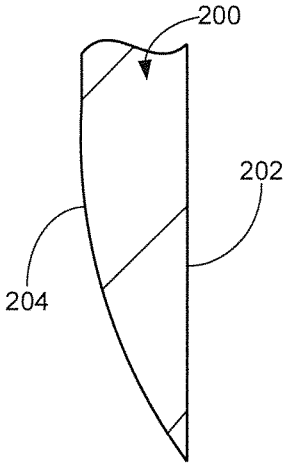
FIG. 11 generally illustrates asymmetrical sharpening operations upon a cutting tool to provide a final desired geometry.

While the geometries set forth by FIGS. 10A-10B are symmetric, similar geometries can readily be established for asymmetric blades, such as an exemplary blade 200 shown in FIG. 11. The asymmetric blade 200 is typical of certain types of cutting tools such as pocket or utility knives with scallops (serrations) along a portion thereof (not separately shown), as well as some types of shears, scissors, etc.

The blade 200 has a first surface 201 that extends in a substantially vertical direction, and an opposing second surface 202 that curvilinearly extends to provide a convex grind surface similar to the surface 174 in FIG. 10B. It will be appreciated that the asymmetric blade 200 can be readily sharpened simply by applying the aforementioned sharpening sequence to just the second surface 202.

Figure 12A:
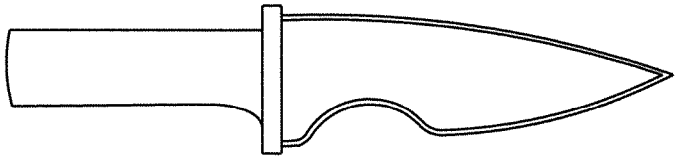
FIGS. 12A and 12B illustrate additional types of cutting tools with various cutting edge features that can be sharpened using the sharpener.
Figure 12B:
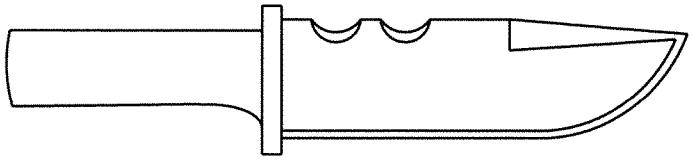

FIGS. 12A-12B provide further examples of tools that can be readily sharpened using the aforementioned sharpening sequence. FIG. 12A shows a first style of utility knife 204 with a blade 205 and handle 206. The blade 205 includes opposing, curvilinearly extending cutting edges 207 and 208. The cutting edge 207 further includes a concave recess 209 useful, for example, in cutting fibrous materials such as a rope. The knife 204 can be sharpened by the sharpener 100 simply by applying the sequence of FIGS. 10A-10B while the knife 204 is in the orientation of FIG. 12A (to sharpen edge 207), flipping the knife over, and repeating (to sharpen edge 208). The aforementioned torsional and bending characteristics of the respective belts are readily capable of providing so-called "razor" sharpness to the entire extents of the edges 207 and 208.

FIG. 12B shows a second type of utility knife 210 with blade 211 and handle 212. The blade 211 has a complex geometry with a lower curvilinear edge 213, a straight cutting edge 214, and scallops (localized serrations) 215. The cutting edges 213 and 214 can be readily sharpened as set forth above. In many cases scallops such as 215 can also be sharpened, albeit in a manner similar to that shown in FIG. 11. It will be noted, however, that the torsional stiffness and width of the belts may need to be adjusted in relation to the relative size of the scallops 215 in order to maintain substantially the same initial geometries of the scallops at the conclusion of the sharpening operation.

It will be noted at this point that complex geometries such as depicted in FIGS. 10-12 with maximum levels of sharpness can generally be obtained only to the extent that the sharpening angle (i.e., the angle between the tool and the abrasive) is maintained within close tolerances during each sharpening pass. Too much variation in the sharpening angle from one pass to the next can actually result in a cutting edge becoming duller as a result of the sharpening operation, since the variations prevent formation of the desired intersection of the respective opposing surfaces. This constitutes a major drawback with most prior art sharpeners.

Even state of the art sharpeners that employ multiple stages of guides and rotating grinding wheels to provide highly controlled sharpening operations are not immune to such variability. Such sharpeners will often require the user to rotate the tool as the tool is drawn back so that the tool takes a curvilinear path to match the curvilinear extent of the cutting surface. While such sharpeners may produce high levels of sharpness, it will be immediately apparent that variations will occur to the extent that the user does not (and cannot) draw the curved blade back at the exact same angle during each pass.

It will thus be seen that the sharpener 100 advantageously provides highly repeatable and controllable sharpening angles for substantially any shape cutting edge, since the sharpening angle is established and maintained by the adaptive torsion of the belt as it reacts to the differences in curvilinearity of the cutting edge. It has been found that sharpeners constructed in accordance with the exemplary sharpener 100 disclosed herein readily achieve levels of sharpness that exceed what is sometimes generally referred to in the art as "scary sharpness" (razor sharp, scalpel sharp, etc.) even for cutting tools with less-than superior metallic constructions.

While the various embodiments discussed above have been configured for the sharpening of bladed cutting tools, such as knives, which can be inserted into the guides 112, it will be appreciated that any number of different types and styles of tools can be sharpened using the sharpener 100 by removal of the guide housing 110 (FIG. 3) and presentation of the tool to the respective exposed extents of the belt 116. Accordingly, any number of other styles and types of cutting tools, such as lawn mower blades, machetes, scissors, swords, spades, rakes, etc. can be effectively sharpened by the sharpener 100 in like manner to that discussed above.

Figure 13:
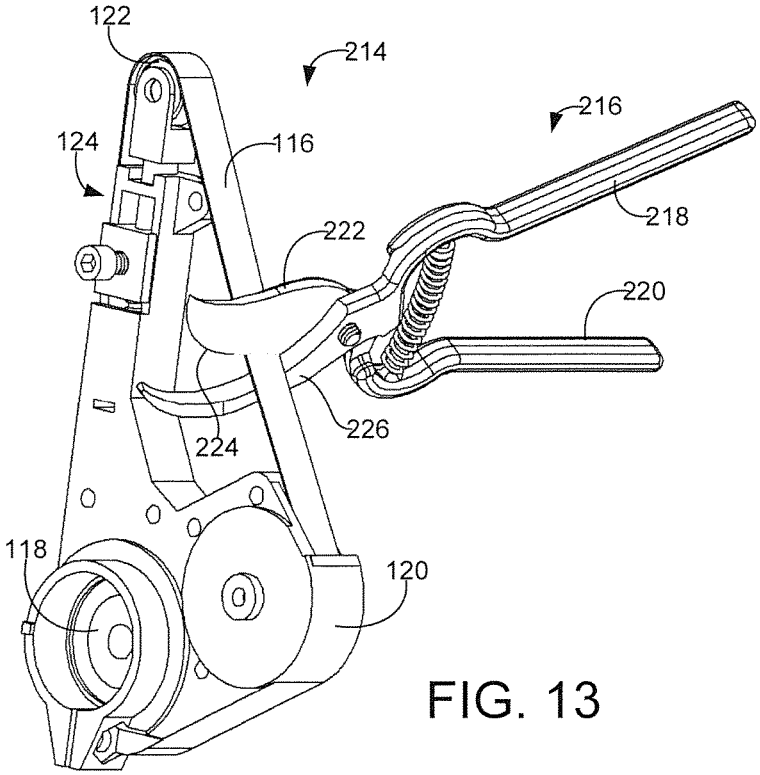
FIG. 13 shows relevant portions of the sharpener in accordance with another embodiment configured to sharpen other types of cutting tools.

An alternative embodiment for the sharpener 100 is generally depicted in FIG. 13, which uses an alternative drive configuration and belt path for the belt 116. Unlike the symmetric arrangement of FIG. 3, the alternative arrangement of FIG. 13 provides an asymmetric triangular path for the belt. As before, the belt passes over rollers 118, 120, 122 and is tensioned by the tensioner 124.

The arrangement of FIG. 13 provides only a single side of the belt for sharpening, such as for a cutting tool 216 characterized as a set of pruning shears. The shears 216 include spring biased handles 218, 220 which, when closed, bring a blade portion 222 with cutting edge 224 into proximity with a shear portion 226.

Figure 14:
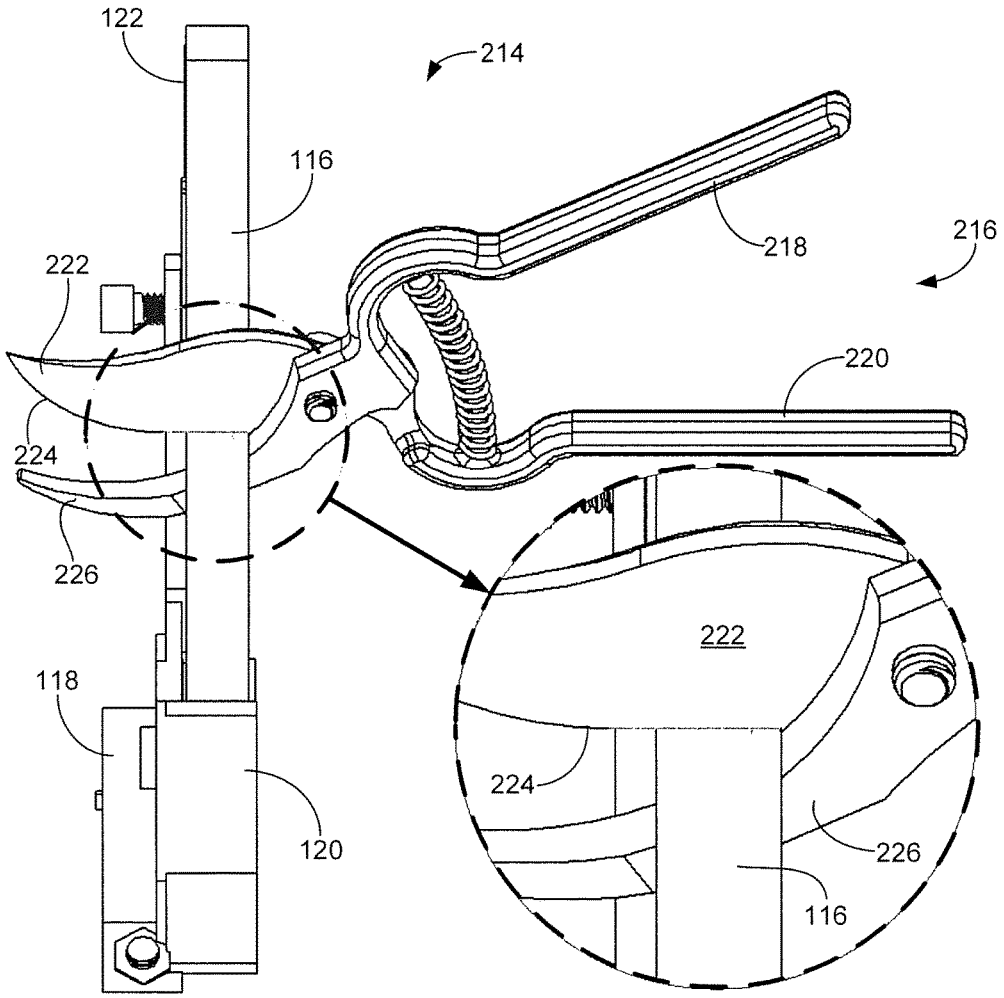
FIG. 14 shows a side elevational view of FIG. 13.

As further shown in FIG. 14, the configuration of the shears is such that the cutting edge 224 lies in close relation to the intersection with the shear portion 226, making the shears difficult to sharpen in this vicinity using conventional processes such as a grinding wheel, due to the lack of clearance. However, generally the only limiting factor with the sharpener 100 is the thickness of the belt 116, so that substantially the entire extent of the cutting edge 224 can be sharpened without the need to disassemble the tool 216. That is, in both the embodiments of FIGS. 3 and 13-14, sufficient clearance is provided behind the belt 116 to provide a bypass clearance to enable a portion of the tool to be disposed behind the belt.

Figure 15:
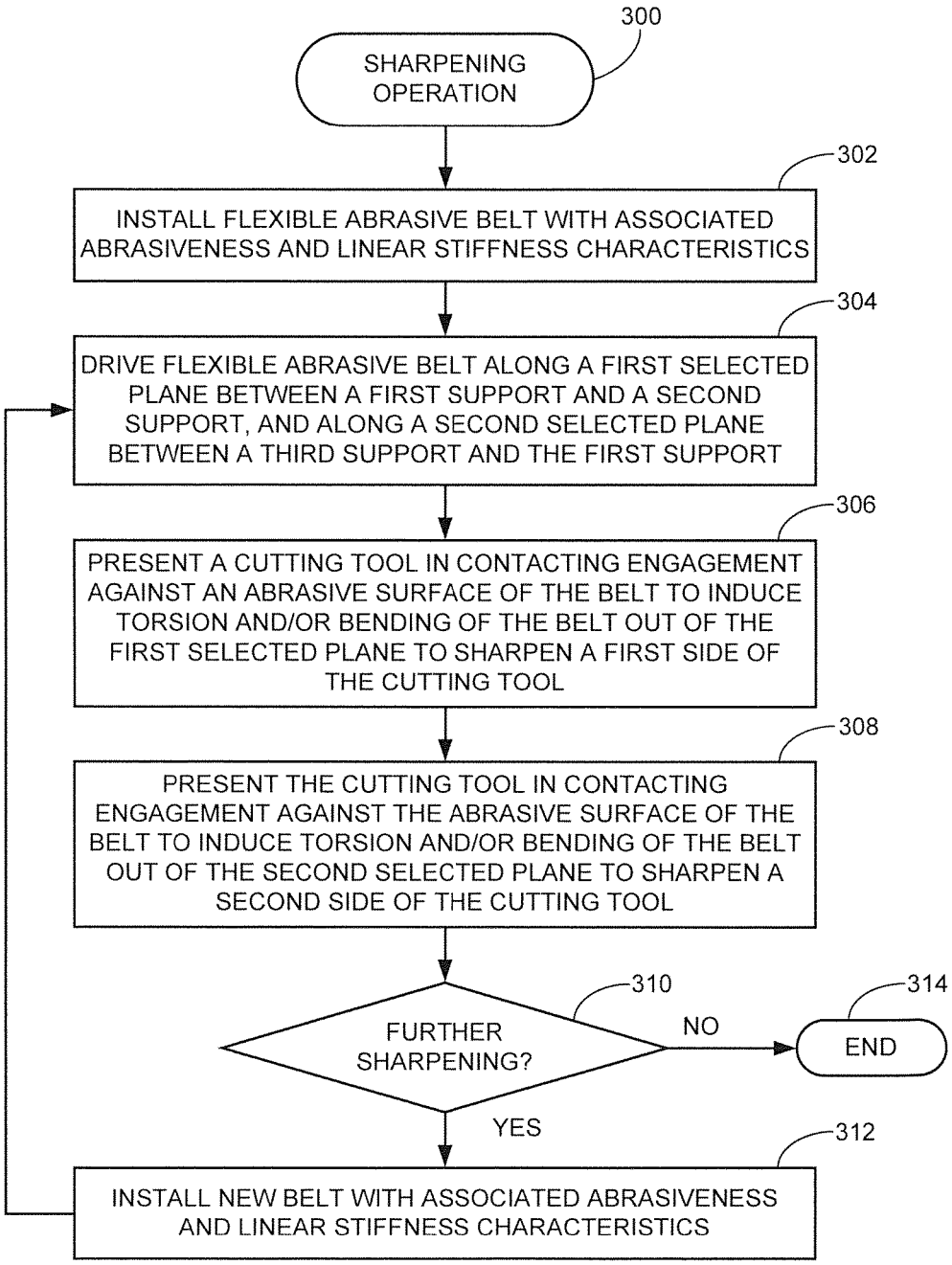
FIG. 15 provides a flow chart for a SHARPENING OPERATION routine generally illustrative of steps carried out in accordance with preferred embodiments of the present disclosure.

FIG. 15 provides a flow chart for a SHARPENING OPERATION routine 300, generally illustrative of steps carried out in accordance with various preferred embodiments of the present disclosure. It will be appreciated that FIG. 15 generally summarizes the foregoing discussion.

Initially, at step 302 a first abrasive flexible belt (such as 116A in FIGS. 5A-5B or 162 in FIG. 10A) is selected and installed onto the sharpener 100. This first abrasive belt will have a selected abrasiveness level and a selected linear stiffness as discussed above. Once installed, the first belt is driven at step 304 via the drive assembly 105 (FIG. 1A) in a selected direction along a selected plane between a first support and a second support (such as between the rollers 122 and 118 in FIG. 3).

At step 306, a cutting tool (such as 114, 132, 204, 210, 216, etc.) is presented in contacting engagement against the abrasive surface of the belt. This induces torsion of the belt out of the selected plane to conform to the cutting edge of the cutting tool (as generally depicted in FIGS. 7-8) and/or bending of the belt out of the selected plane at a radius of curvature determined in relation to said linear stiffness to shape a side surface of the cutting tool with said radius of curvature (as generally depicted in FIGS. 10A-10C).

At this point it will be noted that while preferred embodiments configure the belt to both deflect in a torsional mode to follow changes in the contour of the cutting edge and to deflect in a bending mode to provide a desired radius of curvature to the formed cutting edge, both deflection modes are not necessarily required. That is, while both modes are preferably utilized together, each has separate utility and can be implemented without the other. For example and not by way of limitation, a given tool may be rotated as the tool is drawn back across the belt, thereby removing the advantageous torsional operation of the belt upon the cutting edge. Indeed, the sharpener could be readily configured to support the belt and prevent such torsion, as desired. Accordingly, the flow of FIG. 15 shows that torsion and/or bend modes of deflection are induced during presentation of the tool.

Preferably, the sharpening operation is applied to opposing sides of the tool, such as depicted in FIGS. 10A-10C, so FIG. 15 applies the foregoing step to the other side of the tool at step 308. The operations at steps 306 and 308 can be carried out via the sharpening guides 112, or can be carried out on the belt 116 with the guide housing removed, as depicted in FIGS. 2 and 13-14.

A determination is made at decision step 310 as to whether additional sharpening operations are desired; if so, a new belt is installed onto the sharpener at step 312 and steps 304 through 310 are repeated using the new belt. Preferably, the new belt has a finer abrasiveness level (e.g., 1200 grit v. 400 grit, etc.) and less linear stiffness than then first belt. This sequence will generally result in the generation of a new cutting edge along the cutting tool, as depicted in FIGS. 10B-10C. Once all of the desired sharpening stages have been completed, the routine ends as shown at step 314.

While step 312 sets forth the removal of an existing belt and the installation of a new replacement belt onto the sharpener 100, it will be appreciated that such is not necessarily limiting to the scope of the claimed subject matter. Rather, the sharpener 100 can be readily adapted to concurrently operate multiple belts so that the tool is merely moved from one belt to another during the above sequence.

Any number of sharpener configurations can be employed as desired. As noted previously, the respective bending and twisting modes are dependent on a number of factors relating to the configuration, speed and tension force upon a given abrasive belt.

For purposes of reference, it has been found in preferred embodiments to utilize relatively narrow abrasive belts with lengths on the order of about 12 inches to 18 inches and widths of about 0.5 inches. The distance (journal length) between adjacent supports (e.g., such as the distance along the belt from rollers 118, 122 in FIG. 3) can preferably vary from as low as around 2 inches to up to about 6 inches or more. The linear speed of the belt can also vary, with a preferred range being from about 1,500 feet/minute (ft/min) to about 5,000 ft/min. A preferred tension force supplied to the belt (such as via the tensioner spring 126) is on the order of around 4 pounds (lbs), with a preferred range of from about 0.5 lbs to upwards of about 10 lbs. It will be appreciated that the foregoing values and ranges merely serve to illustrate preferred embodiments and are not limiting.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An apparatus for sharpening a blade having opposing first and second side surfaces that converge to a cutting edge, the apparatus comprising:

a main drive assembly comprising:

an electric motor configured to drive a flexible abrasive belt at a selected speed and direction, the flexible abrasive belt having an abrasive outer surface and a backing layer inner surface; and a base structure configured to support the apparatus on a horizontal surface; and a sharpening assembly coupled to the main drive assembly and comprising:

a plurality of belt support surfaces to provide a routing path for the flexible abrasive belt, the belt support surfaces comprising multiple first support surfaces and multiple second support surfaces configured to contactingly engage the backing layer inner surface to provide first and second belt segments that extend between the multiple first support surfaces and the multiple second support surfaces; and a first blade guide adjacent the first belt segment and a second blade guide adjacent the second belt segment, the first blade guide configured to position the first side of the blade at a first guide angle with respect to the first belt segment with the cutting edge in contact with the abrasive outer surface along the first belt segment, the second blade guide configured to subsequently position the second side of the blade at a second guide angle with respect to the second belt segment with the cutting edge in contact with the abrasive outer surface along the second belt segment.

2. The apparatus of claim 1, wherein at least a selected one of the first or second belt support surfaces comprises at least a portion of an outer surface of a rotatable roller.

3. The apparatus of claim 1, wherein a selected one of the first or second belt support surfaces comprises an outer surface of a drive roller coupled to the electric motor using a torque transfer mechanism to advance the flexible abrasive belt along the routing path at a selected speed and in a selected direction such that material is removed from a portion of the blade held in contact with the flexible abrasive belt.

4. The apparatus of claim 3, wherein the torque transfer mechanism is further configured to alternately advance the flexible abrasive belt along the routing path in an opposing second direction.

5. The apparatus of claim 4, wherein the torque transfer mechanism is further configured to advance the flexible abrasive belt in the selected direction when the blade is placed in the first guide and to advance the flexible abrasive belt in the second selected direction when the blade is placed in the second guide.

6. The apparatus of claim 1, wherein the first guide angle is nominally equal to the second guide angle.

7. The apparatus of claim 1, wherein the first and second belt segments are characterized as non-parallel belt segments.

8. The apparatus of claim 1, wherein the first and second belt segments are characterized as parallel belt segments.

9. The apparatus of claim 1, wherein the first and second blade guides are removably attachable to remaining portions of the sharpening assembly.

10. The apparatus of claim 1, wherein the sharpening assembly further comprises a spring that exerts a bias force to at least a selected one of the belt support surfaces to place the flexible abrasive belt in tension along the routing path.

11. The apparatus of claim 1, wherein each of the first and second blade guides comprises at least one side support surface configured to contactingly engage a selected side of the blade and a cutting edge support surface configured to contactingly engage a first portion of the cutting edge of the blade while a second portion of the cutting edge of the blade contactingly engages the flexible abrasive belt.

12. The apparatus of claim 11, wherein each of the first and second blade guides are characterized as substantially u-shaped slots.

13. The apparatus of claim 11, wherein each of the first and second blade guides are characterized as substantially v-shaped slots.

14. The apparatus of claim 1, wherein the sharpening assembly is further configured to support the belt adjacent the first and second belt segments to contactingly engage the backing layer inner surface of the flexible abrasive surface to prevent torsion of the respective first and second belt segments as the blade is respectively placed in the first and second blade guides.

15. An apparatus for sharpening a blade having opposing first and second side surfaces that converge to a cutting edge, the apparatus comprising:

a flexible abrasive belt having an abrasive outer surface and a backing layer inner surface;

a main drive assembly comprising an electric motor configured to move the flexible abrasive belt along a routing path; and a sharpening assembly coupled to the main drive assembly, comprising:

a plurality of spaced apart belt support surfaces comprising multiple upper support surfaces and multiple lower support surfaces, the belt support surfaces configured to contactingly engage the backing layer inner surface of the flexible abrasive belt to provide the routing path for the flexible abrasive belt with respective first and second planar extents that extend from the multiple upper support surface to the multiple lower support surfaces;

a first blade guide adjacent the first planar extent configured to position the first side of the blade at a first guide angle with respect to the first planar extent as the cutting edge contacts the abrasive outer surface along the first planar extent;

a first support member adjacent the first planar extent configured to contactingly engage the backing layer inner surface of the flexible abrasive belt to prevent torsion of the first planar extent during presentation of the cutting edge against the abrasive outer surface along the first planar extent using the first blade guide;

a second blade guide adjacent the second planar extent configured to position the second side of the blade at a second guide angle with respect to the second planar extent as the cutting edge contacts the abrasive outer surface along the second planar extent;

a second support member adjacent the second planar extent configured to contactingly engage the backing layer inner surface of the flexible abrasive belt to prevent torsion of the second planar extent during presentation of the cutting edge against the abrasive outer surface along the second planar extent using the first blade guide.

16. The apparatus of claim 15, wherein at least a selected one of the upper or lower belt support surfaces comprises an outer surface of a rotatable roller.

17. The apparatus of claim 15, wherein a selected one of the belt support surfaces comprises an outer surface of a drive roller coupled to the electric motor using a torque transfer mechanism to advance the flexible abrasive belt along the routing path at a selected speed and in a selected direction such that material is removed from a portion of the blade held in contact with the flexible abrasive belt.

18. The apparatus of claim 15, wherein the first guide angle is nominally equal to the second guide angle.

19. The apparatus of claim 15, wherein the plurality of spaced apart belt support surfaces comprise outer surfaces of a plurality of rotatable rollers comprising an upper first roller and spaced apart lower second and third rollers, wherein the first planar extent extends tangentially from the first roller to the second roller, and wherein the second planar extent extends tangentially from the first roller to the third roller so that the first and second planar extents are non-parallel.

20. The apparatus of claim 15, wherein the plurality of spaced apart belt support surfaces comprise outer surfaces of a plurality of rotatable rollers comprising an upper first roller and a lower second roller, wherein the first planar extent extends tangentially from a first side of the first roller to a first side of the second roller, and wherein the second planar extent extends tangentially from an opposing second side of the first roller to an opposing second side of the second roller so that the first and second planar extents are parallel.

21. The apparatus of claim 15, wherein the first and second blade guides are removably attachable to remaining portions of the sharpening assembly.

22. The apparatus of claim 15, wherein the sharpening assembly further comprises a spring that exerts a bias force to at least a selected one of the belt support surfaces to place the flexible abrasive belt in tension along the routing path.

23. The apparatus of claim 15, wherein each of the first and second blade guides comprises at least one side support surface configured to contactingly engage a selected side of the blade and a cutting edge support surface configured to contactingly engage a first portion of the cutting edge of the blade while a second portion of the cutting edge of the blade contactingly engages the flexible abrasive belt.

24. An apparatus for sharpening cutting tool having a handle adapted to be grasped by a user and a blade extending from the handle with opposing first and second side surfaces intersecting at a cutting edge therebetween, the apparatus comprising:

an abrasive belt configured for advancement in at least one belt direction along a belt path about a plurality of spaced apart rollers, the abrasive belt comprising an outer abrasive surface, an inner backing surface, a first edge and an opposing second edge;

a first blade guide comprising a first side support surface that extends at a first angle with respect to the abrasive surface of the flexible belt and a plunge depth limiting surface adjacent the first side support surface, the plunge depth limiting surface configured to contactingly engage a portion of the cutting edge as the first side support surface contactingly maintains the blade at the first angle to abrade the first side surface of the blade in a first abrasion direction relative to the cutting edge as the user grasps the handle and inserts the blade into the first blade guide with the handle nearer the first edge than the second edge of the flexible belt;

a second blade guide comprising a second side support surface that extends at a second angle with respect to the abrasive surface of the flexible belt and a plunge depth limiting surface adjacent the second side support surface, the plunge depth limiting surface configured to contactingly engage a portion of the cutting edge as the second side support surface contactingly maintains the blade at the second angle to abrade the second side surface of the blade in a second abrasion direction relative to the cutting edge as the user grasps the handle and inserts the blade into the second blade guide with the handle nearer the first edge than the second edge of the flexible belt, the second angle mirrored with respect to the first angle about a centerline that passes through the abrasive belt equidistant between the first blade guide and the second blade guide.

25. The apparatus of claim 24, wherein the first abrasion direction is opposite the second abrasion direction so that the first abrasion direction is towards the cutting edge and across the second side of the blade and the second abrasion direction is across the first side of the blade and away from the cutting edge.

26. The apparatus of claim 25, wherein the first abrasion direction is equal to the second abrasion direction so that each of the first and second abrasion directions are either towards the cutting edge and across the associated first or second side of the blade or across the associated first or second side of the blade and away from the cutting edge.

27. The apparatus of claim 25, wherein the at least one belt direction comprises a first belt direction when the blade is placed in the first blade guide and a second belt direction when the blade is placed in the second blade guide, the second belt direction opposite the first belt direction.

28. The apparatus of claim 25, wherein the plurality of rollers define tangentially extending first and second belt segments, the first belt segment adjacent the first blade guide, the second belt segment adjacent the second blade guide, the first belt segment parallel to the second belt segment.

29. The apparatus of claim 25, wherein the plurality of rollers define tangentially extending first and second belt segments, the first belt segment adjacent the first blade guide, the second belt segment adjacent the second blade guide, the first belt segment parallel to the second belt segment.

30. The apparatus of claim 25, further comprising a first belt support member configured to contactingly engage the backing surface of the abrasive belt to reduce torsion of the abrasive belt adjacent the first blade guide as the blade is inserted therein, and a second belt support member to contactingly engage the backing surface of the abrasive belt to reduce torsion of the abrasive belt adjacent the second blade guide as the blade is inserted therein.

* * * * *